US010985861B2

(12) United States Patent
Nguyen et al.

(10) Patent No.: US 10,985,861 B2
(45) Date of Patent: Apr. 20, 2021

(54) ENERGY-EFFICIENT REACTIVE JAMMING OF FREQUENCY-HOPPING SPREAD SPECTRUM (FHSS) SIGNALS USING SOFTWARE-DEFINED RADIOS

(71) Applicant: Drexel University, Philadelphia, PA (US)

(72) Inventors: Danh H. Nguyen, Philadelphia, PA (US); Marko Jacovic, Philadelphia, PA (US); Cem Sahin, Peoria, AZ (US); Kapil R. Dandekar, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 130 days.

(21) Appl. No.: 16/284,574

(22) Filed: Feb. 25, 2019

(65) Prior Publication Data

US 2019/0268087 A1 Aug. 29, 2019

Related U.S. Application Data

(60) Provisional application No. 62/634,234, filed on Feb. 23, 2018.

(51) Int. Cl.
*H04K 3/00* (2006.01)

(52) U.S. Cl.
CPC ..... *H04K 3/827* (2013.01); *H04K 3/42* (2013.01); *H04K 3/45* (2013.01)

(58) Field of Classification Search
CPC ..... H04K 3/42; H04K 3/827
USPC ..... 455/67.11, 1
See application file for complete search history.

(56) References Cited

U.S. PATENT DOCUMENTS 4,843,612 A * 6/1989 Brusch ..... H04B 1/713 375/133
9,531,497 B2 * 12/2016 Shishkin ..... H04K 3/45
2006/0140251 A1 * 6/2006 Brown ..... H04K 3/25 375/135
2014/0112241 A1 * 4/2014 Gayrard ..... H04B 7/2041 370/316

OTHER PUBLICATIONS

"Wireless Innovations for Tomorrow," Welcome to the Drexel Wireless Systems Laboratory, accessed at https://web.archive.org/web/20180616105600/https://wireless.ece.drexel.edu/, accessed on Jun. 20, 2019, pp. 5.
Nguyen, D., et al., "A real-time and protocol-aware reactive jamming framework built on software-defined radios," Proceeding SRIF '14 Proceedings of the 2014 ACM workshop on Software radio implementation forum, pp. 15-22 (2014).

* cited by examiner

*Primary Examiner* — John J Lee
(74) *Attorney, Agent, or Firm* — Schott, P.C.

(57) ABSTRACT

A reactive jamming software defined radio (SDR) apparatus to target Frequency Hopping Spread-Spectrum (FHSS) signals includes a peripheral module for SDR processing; a reactive jamming hardware IP core that implements time-sensitive operations on a field programmable gate array (FGPA); and a host computer that implements non-time-critical operations, such as jammer configuration, logging, and strategy composition.

6 Claims, 3 Drawing Sheets

ENERGY-EFFICIENT REACTIVE JAMMING OF FREQUENCY-HOPPING SPREAD SPECTRUM (FHSS) SIGNALS USING SOFTWARE-DEFINED RADIOS

BACKGROUND

Software-Defined Radio (SDR) technology has become a mainstay in the field of wireless communications due to its runtime reconfigurability, which is achieved by implementing most of the traditional radio communication processes in software instead of dedicated hardware. Current SDR platforms provide a fast, user-friendly prototyping environment for a wide range of communications protocols and allow for experimental field studies with minimal resource investment into dedicated hardware or firmware design.

Meanwhile, reactive jamming is a serious, stealthy, and energy-efficient way to perform attacks and disable communication in networks that use SDR technology. One such threat is the Denial-of-Service (DoS) attack, wherein the adversary transmits interfering signals, i.e. jamming signals, to make the network unavailable to legitimate users. In its most basic form, a DoS attack can just be a continuous inband jamming signal with sufficient power to corrupt all transmitted packets. These continuous jammers, though simple to implement, suffer from two disadvantages: High power requirement and high probability of detection. On the other hand, reactive jammers are more efficient due to their ability to sense the wireless medium and jam packets that are already in the air. By jamming wireless packets reactively at critical moments, adversaries can significantly reduce network throughput using little energy while minimizing the chances of being detected. Nevertheless, reactive jammers have not been considered a serious threat in practice, mainly due to the implementation challenges in meeting strict real-time constraints for detecting and reacting to in-flight packets of high-speed wireless networks.

Current software-defined radios provide a fast and user-friendly way to launch and iteratively enhance reactive jamming against multiple communication paradigms, including narrowband, wideband OFDM, direct-sequence spread spectrum, and frequency-hopping spread spectrum signals. Due to their PHY layer flexibility, however, achieving high-performance and real-time reactive jamming operations on SDRs remains a challenge. Recent research in wireless communications has emphasized securing the physical layer against external threats, however, due to limitations of host side signal processing, particularly due to latency constraints, the real-time requirement of reactive jamming and threat detection has not been met.

SUMMARY OF THE EMBODIMENTS

A reactive jamming software defined radio (SDR) apparatus to target Frequency Hopping Spread-Spectrum (FHSS) signals includes a peripheral module for SDR processing; a reactive jamming hardware IP core that implements time-sensitive operations on a field programmable gate array (FGPA); and a host computer that implements non-time-critical operations, such as jammer configuration, logging, and strategy composition.

Bluetooth is a frequency hopping, spread spectrum wireless standard used to send data across short distances. It may operate between 2.400 and 2.4835 GHz at transmit powers from 1 mW to 100 mW, depending on class of device (Class 1-3). Bluetooth frequency hops at a rate of 1600 times per second over 79 hop channels spaced 1 MHz apart using an unpredictable pseudo-random hopping pattern. This project may include a Bluetooth follow-on jammer on an Ettus Universal Software Radio Peripheral USRP x300/x310, capable of detecting a hop and applying energy on that frequency quickly enough to disrupt the Bluetooth communications. The jamming signal generated may be a modulated signal similar to a Bluetooth signal or some other modulation method, but may not be a simple repeated version of the incoming signal.

DETAILED DESCRIPTION OF THE EMBODIMENTS

Introduction

Figure 1A:
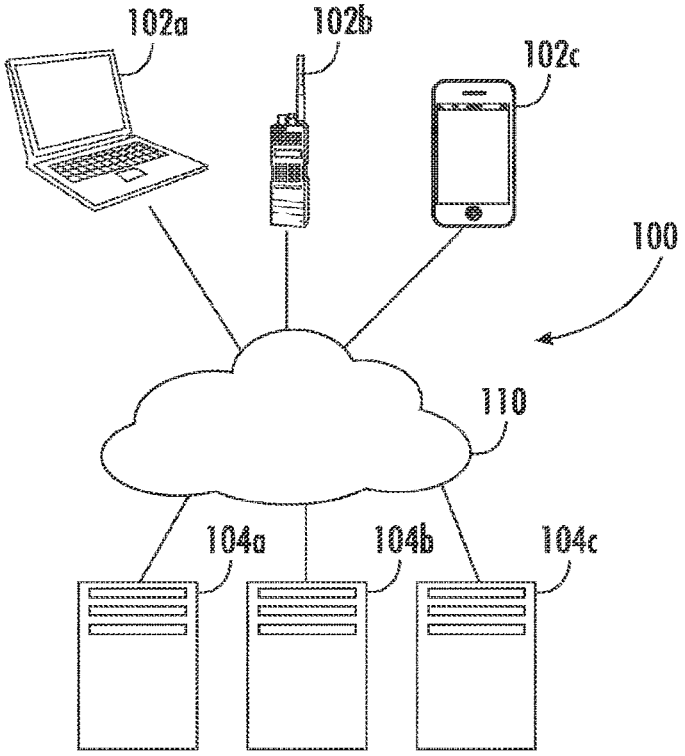
FIG. 1A shows an embodiment of a network environment.

The system and method using the apparatus may be implemented using system and hardware elements shown and described herein. For example, FIG. 1A shows an embodiment of a network 100 with one or more clients 102*a*, 102*b*, 102*c* that may be local machines, personal computers, mobile devices, servers, tablets that communicate through one or more networks 110 with servers 104*a*, 104*b*, 104*c*. It should be appreciated that a client 102*a*-102*c* may serve as a client seeking access to resources provided by a server and/or as a server providing access to other clients.

The network 110 may be wired or wireless links. If it is wired, the network may include coaxial cable, twisted pair lines, USB cabling, or optical lines. The wireless network may operate using BLUETOOTH, Wi-Fi, Worldwide Interoperability for Microwave Access (WiMAX), infrared, or satellite networks. The wireless links may also include any cellular network standards used to communicate among mobile devices including the many standards prepared by the International Telecommunication Union such as 3G, 4G, and LTE. Cellular network standards may include GSM, GPRS, LTE, WiMAX, and WiMAX-Advanced. Cellular network standards may use various channel communications such as FDMA, TDMA, CDMA, or SDMA. The various networks may be used individually or in an interconnected way and are thus depicted as shown in FIG. 1A as a cloud.

The network 110 may be located across many geographies and may have a topology organized as point-to-point, bus, star, ring, mesh, or tree. The network 110 may be an overlay network which is virtual and sits on top of one or more layers of other networks.

A system may include multiple servers 104*a*-*c* stored in high-density rack systems. If the servers are part of a common network, they do not need to be physically near one another but instead may be connected by a wide-area network (WAN) connection or similar connection.

Management of group of networked servers may be de-centralized. For example, one or more servers 104*a*-*c* may include modules to support one or more management services for networked servers including management of dynamic data, such as techniques for handling failover, data replication, and increasing the networked server's performance.

The servers 104*a*-*c* may be file servers, application servers, web servers, proxy servers, network appliances, gateways, gateway servers, virtualization servers, deployment servers, SSL VPN servers, or firewalls.

When the network 110 is in a cloud environment, the cloud network 110 may be public, private, or hybrid. Public clouds may include public servers maintained by third parties. Public clouds may be connected to servers over a public network. Private clouds may include private servers that are physically maintained by clients. Private clouds may be connected to servers over a private network. Hybrid clouds may, as the name indicates, include both public and private networks.

The cloud network may include delivery using IaaS (Infrastructure-as-a-Service), PaaS (Platform-as-a-Service), SaaS (Software-as-a-Service) or Storage, Database, Information, Process, Application, Integration, Security, Management, Testing-as-a-service. IaaS may provide access to features, computers (virtual or on dedicated hardware), and data storage space. PaaS may include storage, networking, servers or virtualization, as well as additional resources such as, e.g., the operating system, middleware, or runtime resources. SaaS may be run and managed by the service provider and SaaS usually refers to end-user applications. A common example of a SaaS application is SALESFORCE or web-based email.

A client 102*a-c* may access IaaS, PaaS, or SaaS resources using preset standards and the clients 102*a-c* may be authenticated. For example, a server or authentication server may authenticate a user via security certificates, HTTPS, or API keys. API keys may include various encryption standards such as, e.g., Advanced Encryption Standard (AES). Data resources may be sent over Transport Layer Security (TLS) or Secure Sockets Layer (SSL).

Figure 1B:
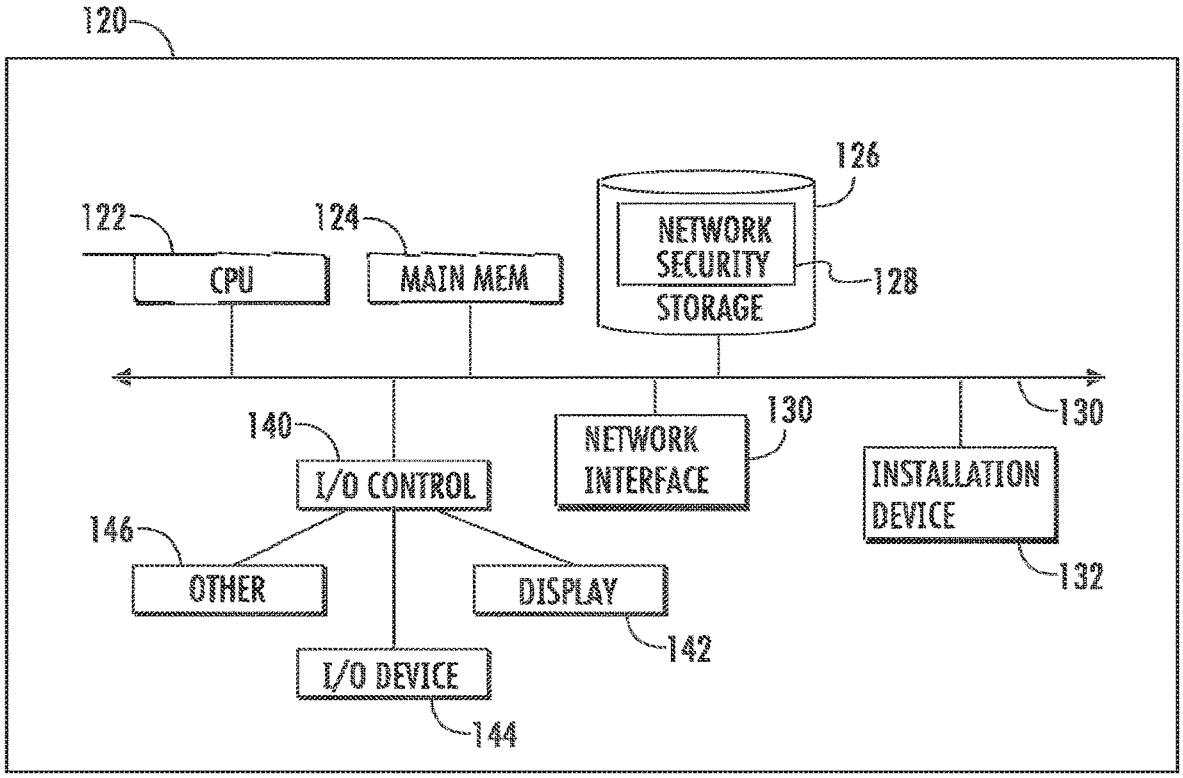
FIG. 1B shows block diagrams of a computing device.

The clients 102*a-c* and servers 104*a-c* may be embodied in a computer, network device or appliance capable of communicating with a network and performing the actions herein. FIGS. 1A and 1B show block diagrams of a computing device 120 that may embody the client or server discussed herein. The device 120 may include a system bus 150 that connects the major components of a computer system, combining the functions of a data bus to carry information, an address bus to determine where it should be sent, and a control bus to determine its operation. The device includes a central processing unit 122, a main memory 124, and storage device 124. The device 120 may further include a network interface 130, an installation device 132 and an I/O control 140 connected to one or more display devices 142, I/O devices 144, or other devices 146 like mice and keyboards.

The storage device 126 may include an operating system, software, and a network user behavior module 128, in which may reside the network user behavior system and method described in more detail below.

The computing device 120 may include a memory port, a bridge, one or more input/output devices, and a cache memory in communication with the central processing unit.

The central processing unit 122 may be a logic circuitry such as a microprocessor that responds to and processes instructions fetched from the main memory 124. The CPU 122 may use instruction level parallelism, thread level parallelism, different levels of cache, and multi-core processors. A multi-core processor may include two or more processing units on a single computing component.

The main memory 124 may include one or more memory chips capable of storing data and allowing any storage location to be directly accessed by the CPU 122. The main memory unit 124 may be volatile and faster than storage memory 126. Main memory units 124 may be dynamic random access memory (DRAM) or any variants, including static random access memory (SRAM). The main memory 124 or the storage 126 may be non-volatile.

The CPU 122 may communicate directly with a cache memory via a secondary bus, sometimes referred to as a backside bus. In other embodiments, the CPU 122 may communicate with cache memory using the system bus 150. Cache memory typically has a faster response time than main memory 124 and is typically provided by SRAM or similar RAM memory.

Input devices may include smart speakers, keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include the same smart speakers, video displays, graphical displays, speakers, headphones, inkjet printers, laser printers, and 3D printers.

Additional I/O devices may have both input and output capabilities, including haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures.

In some embodiments, display devices 142 may be connected to the I/O controller 140. Display devices may include liquid crystal displays (LCD), thin film transistor LCD (TFT-LCD), blue phase LCD, electronic papers (e-ink) displays, flexile displays, light emitting diode displays (LED), digital light processing (DLP) displays, liquid crystal on silicon (LCOS) displays, organic light-emitting diode (OLED) displays, active-matrix organic light-emitting diode (AMOLED) displays, liquid crystal laser displays, time-multiplexed optical shutter (TMOS) displays, or 3D displays.

The computing device 120 may include a network interface 130 to interface to the network 110 through a variety of connections including standard telephone lines LAN or WAN links (802.11, T1, T3, Gigabit Ethernet), broadband connections (ISDN, Frame Relay, ATM, Gigabit Ethernet, Ethernet-over-SONET, ADSL, VDSL, BPON, GPON, fiber optical including FiOS), wireless connections, or some combination of any or all of the above. Connections can be established using a variety of communication protocols. The computing device 120 may communicate with other computing devices via any type and/or form of gateway or tunneling protocol such as Secure Socket Layer (SSL) or Transport Layer Security (TLS). The network interface 130 may include a built-in network adapter, network interface card, PCMCIA network card, EXPRESSCARD network card, card bus network adapter, wireless network adapter, USB network adapter, modem or any other device suitable for interfacing the computing device 120 to any type of network capable of communication and performing the operations described herein.

The computing device 120 may operate under the control of an operating system that controls scheduling of tasks and access to system resources. The computing device 120 may be running any operating system such as any of the versions of the MICROSOFT WINDOWS operating systems, the different releases of the Unix and Linux operating systems, any version of the MAC OS for Macintosh computers, any embedded operating system, any real-time operating system, any open source operating system, any proprietary operating system, any operating systems for mobile computing devices, or any other operating system capable of running on the computing device and performing the operations described herein.

The computer system 120 can be any workstation, telephone, desktop computer, laptop or notebook computer, netbook, tablet, server, handheld computer, mobile telephone, smartphone or other portable telecommunications device, media playing device, a gaming system, mobile computing device, or any other type and/or form of computing, telecommunications or media device that is capable of communication.

Device

Real-time jamming devices have been previously described in U.S. Pat. No. 9,531,497, the contents of which are incorporated by reference as if fully set forth herein.

An SDR-based real-time reactive jammer may specifically target frequency-hopping spread spectrum (FHSS) signals. By using an SDR approach, the jamming can be reconfigured on the fly to iteratively tune all operational aspects, including detection methods, target false alarm rates, jamming signal waveforms, jamming durations, jamming energy, and targeted temporal "location" of the victim signals (i.e., jamming with a user-specified temporal delay). To achieve high-performance and meet real-time deadlines (i.e., jamming while the victim packet is still in-flight), the hardware/software co-processing SDR architecture for real-time reactive jamming, wherein time-critical operations, such as signal detection, jamming activation, and jamming signal composition, may be moved to FPGA hardware.

Other non-time-critical tasks, including signal feature extractions and strategy decisions, may remain in host software for flexibility. To enable reactive jamming against FHSS signals, a custom hardware IP core may handle two time-sensitive tasks: (i) wideband signal detection over the entire jamming operational bandwidth (at least 80 MHz), and (ii) narrowband reactive jamming of wireless activities (including frequency-hopping signals) on the detected portion of the bandwidth. Narrowband, herein, means any fraction of the operational bandwidth, up to and including the entire bandwidth itself. For example, target reactive jamming subband can be 1 MHz (1/80 BW), 5 MHz (1/16 BW), 40 MHz (½ BW), or 80 MHz (entire BW).

One target application of an SDR jammer is a Bluetooth follow-on (reactive) jammer. For detection, a channelization approach with hierarchical, multi-stage, energy-based signal detection may be used. The 80 MHz band may be divided into multiple sub-bands, essentially clustering a large number (80) 1 MHz channels together. Based on the event of a sub-band exceeding an energy threshold, the Bluetooth channels that exist within that sub-band may be further examined. Detected energy greater than the threshold of the second stage determines if that channel sub-band is being used for communication. Both energy detection stages involve the use of parallel channelized band-pass filters (BPF) and adaptive detection thresholds.

For reactive jamming operations, a 1 MHz signal with reconfigurable waveform parameters (modulation type, active duty-cycle, and jamming temporal delay) may be transmitted on the detected 1 MHz sub-band occupying Bluetooth target signals. By targeting frequency-hopped activities on particular sub-bands, the reactive jammer discussed herein achieves energy efficiency in two different aspects: (i) it may only activate jamming when wireless activities are detected, thereby conserving energy and minimizing probability of detection, and (ii) it may only jam on detected 1-MHz sub-band (i.e. a fraction of total bandwidth), instead of jamming the entire operational bandwidth, which can be extremely wide band and energy costly.

Figure 2:
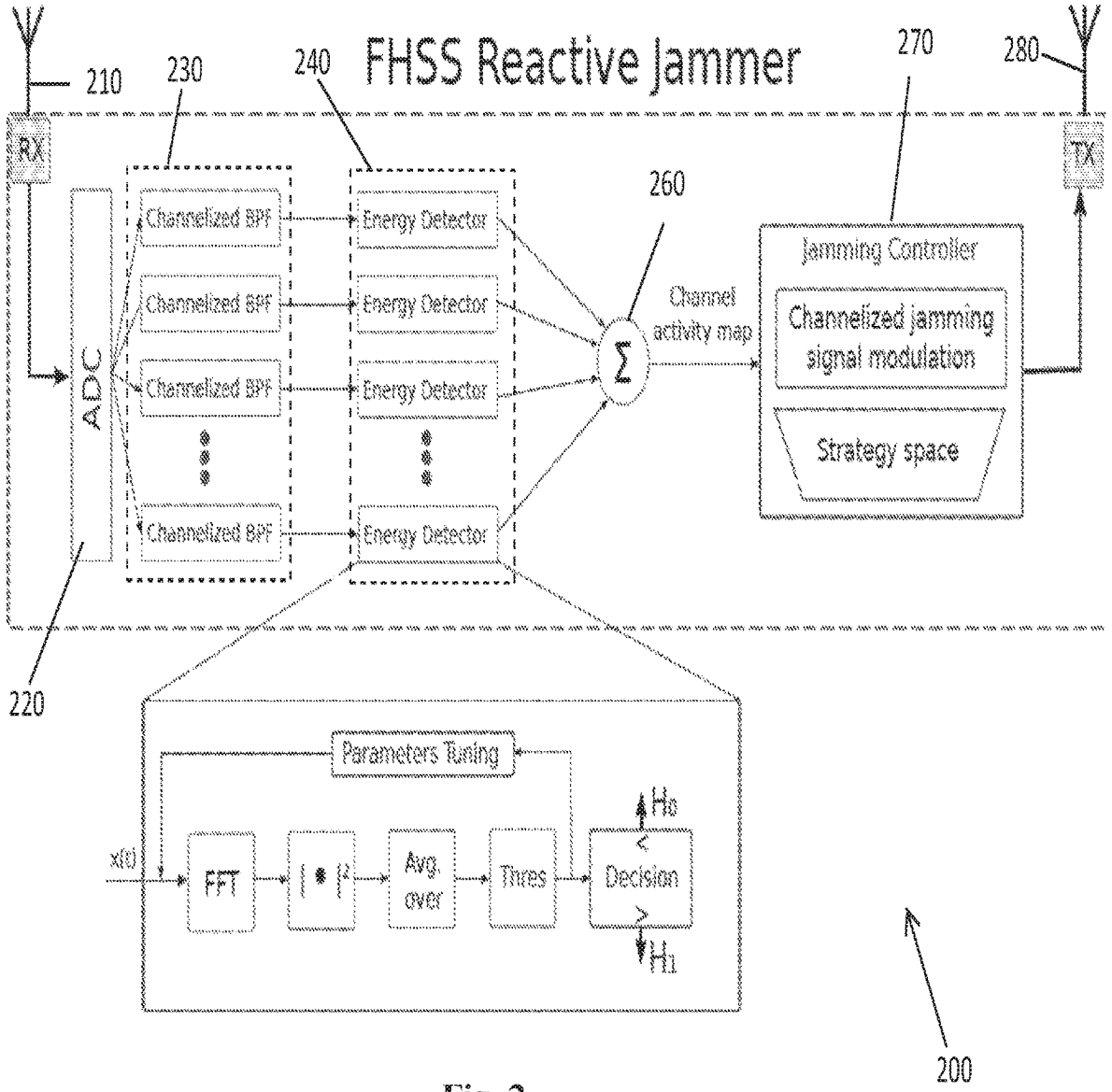
FIG. 2 shows an overview of a FHSS reactive jamming apparatus.

FIG. 2 shows an agile follow-on jammer 200. The jammer 200 may include several components, a receiving antenna 210, an analog to digital (ADC) converter 220, band pass filters (BPFs) 230, energy detectors 240, an adder 260, a jamming controller 270, and a transmitting antenna 280.

In practice, FHSS reactive jammer 200 receives a signal to its receiving antenna 210. The signal is digitally converted from analog to digital by the ADC converter 220 and then split as described herein into separate channel sub-bands using the BPFs 230.

Each channelized sub-band channel from each BPF 230 is transmitted to an energy detector 240. Within each energy detector 240, a decision is made as to whether the sub-band channel exceeds a predetermined threshold, and if it does, the channels that exist within the band will be further examined and detected energy greater than the threshold of the second stage will determine if a channel is being used for communication. The predetermined threshold may be derived from observations of an inactive channel, that is, the measurement may be made on spectrum in which it is known that there is not active usage. These observations may be used to approximate the effect of thermal noise on the receiver sensitivity, and use a value relative to the noise estimate for energy detection. The adder 260 takes binary decisions of energy present on the bands. In the event that no determination is made, there is no active response. The jammer 200 may work in a reactive manner, and continue to sense the environment if the decision is not met.

The sub-band channels are then re-configured into a single signal in an adder 260, which creates a channel activity map that is sent to a jamming controller 270. The channel activity map identifies the separate channel sub-bands that exceed the predetermined energy threshold. The jamming controller 270 identifies the channels used for communications from this channel activity map and based thereon, may transmit, via a transmission antenna 280 jamming signals to interfere with signal activity. Different jamming signals may be used: Either a repeat attack in which the received signal is re-transmitted back, or a noise signal may be sent.

The jammer 200 may include, for hardware, the following:

- Universal Software Radio Peripheral SDR module: peripheral module for SDR processing.
- Custom-built field-programmable gate arrays (FPGA) image: a custom-built reactive jamming hardware IP core that handles time-sensitive operations on the FPGA. This core may handle two important tasks for reactive jamming of FHSS signals in real time: (i) wideband signal detection, and (ii) narrowband reactive jamming of wireless activities on the detected band.

For detection, the channelization approach with hierarchical, multi-stage, energy-based signal detection may be used. For Bluetooth, the 80 MHz Bluetooth band may be divided into multiple sub-bands, essentially clustering several 1 MHz channels together. Based on the event of a sub-band exceeding an energy threshold, the Bluetooth channels that exist within the band may be further examined.

Detected energy greater than the threshold of the second stage will determine if a channel is being used for communication. Both energy detection stages may involve the use of parallel band pass filters and adaptive detection thresholds. A parallel implementation may reduce the latency of the detection scheme. Multiple instances of the band pass filters and energy detectors may be used, as shown, with each tuned for different frequency bands but including the same capabilities. The trade-off comprises resource utilization and latency—using additional resources to reduce the latency results from using only one band pass filter and energy detector (delay may come from reconfiguring and buffering the data until the previous band has been processed). The use of a hierarchical design may allow for a median between the tradeoff.

In addition, adaptive thresholds may be necessary for use in varying wireless environments. The hierarchical structure may reduce resource utilization which is a necessary aspect of hardware design.

In a use case for reactive jamming, a 1 MHz signal with reconfigurable waveform type and duration may be transmitted on the detected Bluetooth channel. The generated signal may be shifted in frequency to allow for the carrier frequency of the radio to remain centered at the middle of the Bluetooth band. In full duplex operation the radio may use a single local oscillator, in which changing the carrier frequency for the transmitter would hinder the wide band sensing of the receiver. A frequency shift to the center of the detected channel may enable jamming without reducing the performance of the sensing mechanism. Furthermore, the sensing stages may ignore energy detected on the channel that is being jammed in consideration of a self-interfering signal yielding a false detection. The wideband sensing and jamming schemes will be designed on FPGA to reduce the latency required, allowing for real-time processing.

Host computer, applications, and system verification: Several non-time-critical operations, such as jammer configuration, logging, and strategy composition may be implemented on a host computer. This additional capability may enable run-time reconfiguration of the follow-on Bluetooth jammer.

The jammer herein may be used in a personal home defense network, military defense networks, and portable defense systems, and incorporated into bi-directional radios for use in many applications and devices.

While the invention has been described with reference to the embodiments above, a person of ordinary skill in the art would understand that various changes or modifications may be made thereto without departing from the scope of the claims.

The invention claimed is:

1. A target Frequency Hopping Spread Spectrum (FHSS) reactive jamming radio comprising:

at least one band pass filters that separate a received signal into separate channel sub-bands;

at least one energy detector that receives the separate channel sub-bands and determines whether the separate channel sub-band exceeds a predetermined energy threshold;

a jamming controller that controls transmission of a jamming signal to disrupt the received signal, based upon whether the separate channel sub-band exceeds a predetermined energy threshold;

a receiving antenna that receives the received signal;

an analog to digital converter (ADC) that converts the received signal from analog to digital and transmits the received signal to the at least one bandpass filters; and an adder that receives the separate channel sub-band signals from the at least one energy detectors;

wherein the adder transmits a channel activity map to the jamming controller, wherein the channel activity map identifies the separate channel sub-bands that exceed the predetermined energy threshold.

2. The radio of claim 1, further comprising a transmission antenna that transmits the jamming signal.

3. The radio of claim 1, wherein the jamming signal is a repeat attack in which the received signal is re-transmitted.

4. The radio of claim 1, wherein the jamming signal is a noise signal.

5. The radio of claim 1, wherein there are multiple band pass filters and energy detectors, each tuned for different frequency bands.

6. The radio of claim 1, wherein the predetermined threshold is derived from observations of an inactive channel.

* * * * *